US005954016A

United States Patent [19]

Westerbeke, Jr.

[11] Patent Number: 5,954,016

[45] **Date of Patent: *Sep. 21, 1999**

[54] ENGINE COOLING METHOD AND DEVICE

[75] Inventor: John H. Westerbeke, Jr., Milton, Mass.

[73] Assignee: Westerbeke Corporation, Avon, Mass.

[ * ] Notice: This patent issued on a continued prosecution application filed under 37 CFR 1.53(d), and is subject to the twenty year patent term provisions of 35 U.S.C. 154(a)(2).

[21] Appl. No.: 08/897,128

[22] Filed: Jul. 18, 1997

[51] Int. Cl.[6] ..... F01P 9/00

[52] U.S. Cl. ..... 123/41.18; 123/41.57

[58] Field of Search ..... 123/41.18, 41.01, 123/41.57, 196 AB

[56] References Cited

U.S. PATENT DOCUMENTS

| | | | |
|---|---|---|---|
| 1,316,912 | 9/1919 | Marschall | 123/41.57 |
| 1,317,750 | 10/1919 | Baker | 123/41.18 |
| 1,607,571 | 11/1926 | Smith . | |
| 1,725,121 | 8/1929 | Wintercorn . | |
| 4,108,118 | 8/1978 | George . | |
| 4,621,680 | 11/1986 | Funabashi . | |
| 5,261,357 | 11/1993 | Suh | 123/41.57 |

*Primary Examiner*—John T. Kwon
*Attorney, Agent, or Firm*—Fish & Richardson P.C.

[57] ABSTRACT

A method and device for cooling engines and other heat sources having housings with fins protruding from a surface thereof for direct convective heat transfer with a fluid medium, particularly applicable for cooling engines constructed to be air-cooled. The invention features a cooling jacket having recesses defined in a surface thereof for receiving the fins of the housing of the heat source, and a coolant passage defined therein. The cooling jacket is placed in close proximity to the heat source housing, such that the fins of the housing of the heat source protrude into the recesses of the cooling jacket. The small gap between the contoured heat source and jacket surfaces is filled with a thermally conductive material to enhance heat transfer from the heat source to the jacket. The cooling jacket can be readily mounted to an assembled, commercially engine to transform the engine from air-cooling to liquid-cooling.

36 Claims, 4 Drawing Sheets

ENGINE COOLING METHOD AND DEVICE

BACKGROUND OF THE INVENTION

This invention relates to methods and devices for liquid cooling the heat sinks of engines and the like.

Gasoline and diesel powered engines are typically either cooled by convective heat transfer from the engine directly to atmospheric air, or by cooling systems which circulate fluid coolant through internal coolant passages in the engine. Engines of the former type are sometimes called "air-cooled" engines, while those of the latter type are commonly called "liquid-cooled" or "water-cooled". In indirect liquid cooling, coolants such as a mixture of ethylene glycol and water are circulated in a closed system to and from a remote radiator. In direct liquid cooling, water from a bulk source (e.g., lake or sea water in a marine application) is circulated through the engine. Most modern automobile engines have indirect liquid-cooling, while many marine engines have direct liquid-cooling. Many smaller engines employed, for instance, in motorcycle and generator applications, are air-cooled.

Air-cooled engines typically have heat sinks with extensive arrays of exposed fins to provide a significant surface area for the dissipation of heat into the atmosphere. As used herein, "fin" refers to any shape of protrusion extending from a surface for dissipating heat therefrom. As the heat-dissipating capacity of the heat sink is directly related to the surface area of the heat sink in direct contact with the air, it is common to cover as much of the heat sink with fins as is practically possible. Frequently, the fins are in the form of parallel, narrow ridges extending a substantial distance outward from the heat sink. For example, some ridge-form fins extend outward a distance more than five times their thickness, and are separated by gaps only about as wide as the fins themselves.

Although air-cooled systems may generally be considered less complicated than liquid-cooled systems due to the absence of the requisite coolant, seals and pumping means, they generally require a flow of cool air directly across the heat sink. Liquid-cooled systems can remove heat, via the liquid coolant circulated through plumbing, to convenient, remote areas for dissipation.

Air-cooled engines of various designs are commercially produced in high volumes by engine manufacturers and available for incorporation by manufacturers of engine-driven systems into the designs of their products. Cost considerations typically favor the selection of a readily available, standard engine design of high volume production for use in a new engine-driven system.

SUMMARY OF THE INVENTION

We have realized that certain modifications can increase the suitability of commercially available air-cooled engines and the like for use in other applications, by the addition of a cooling jacket to the engine heat sink to enable liquid cooling of the engine via the fins (i.e., protrusions) provided for air cooling.

According to one aspect of the invention, a method is provided for cooling a heat source having a housing with fins protruding from a surface thereof for direct convective heat transfer with a fluid medium. The method includes placing a cooling jacket in close proximity to the heat source housing. The cooling jacket has recesses defined in a surface thereof, for receiving the fins of the housing of the heat source, and a coolant passage defined therein. With the jacket placed in close proximity to the heat source housing, the fins of the housing of the heat source protrude into the recesses of the cooling jacket in a heat transferring relationship. Liquid coolant is flowed through the coolant passage of the cooling jacket, thereby cooling the heat source.

Typically, a gap is defined between the fins and recesses. The gap is preferably filled with a thermally conductive material to enhance the heat transfer between the heat sink and the cooling jacket.

The method of the invention has particular applicability to engines constructed to be air-cooled by flowing air across their fins, and provides a cost-effective means of modifying such air-cooled engines to enable liquid cooling, such as by water or other liquid coolants. The cooling jacket can be provided by scanning a finned surface of the engine to determine the topology of the finned surface, and then constructing the cooling jacket to accommodate the determined topology.

Preferably, the gap between the fins and recesses has a nominal thickness of less than about 0.050 inch, more preferably less than about 0.020 inch.

The thermally conductive material in the gap between the heat source and the cooling jacket should have a relatively high thermal conductivity, preferably at least about 10 $btu/ft^2/°F./hr/in$ and more preferably at least about 20 $btu/ft^2/°F./hr/in$.

The thermally conductive material should also have a relatively high room temperature bond shear strength (i.e., at about 750° F.), preferably of about 1,500 or more pounds per square inch and more preferably of about 2,500 or more pounds per square inch, when bonded to the material of the mating fins and recesses.

In some applications, such as in marine engine cooling, for example, the liquid coolant comprises sea water.

According to another aspect of the invention, a cooling jacket for transforming an air-cooled engine into a liquid-cooled engine, by removing heat from heat dissipation protrusions on a heat sink of the engine by a flow of liquid coolant, is provided. The cooling jacket includes a jacket housing having an external surface and an internal coolant passage with an inlet and an outlet, with recesses defined in the external surface of the jacket housing. The recesses are contoured to approximate the external shape of the heat dissipation protrusions on the engine heat sink.

In some embodiments, the jacket housing comprises an aluminum alloy. The external surface of the jacket housing is, in some cases, of sand-cast form.

In some embodiments, the cooling jacket includes at least two housing portions constructed to cooperate to enclose a finned engine component, such as to surround most of the finned outer surface of the casing about a single cylinder, for example.

According to another aspect of the invention, an engine includes the above-described cooling jacket mounted to a finned surface of the engine, preferably with a solid, thermally conductive material between the external surface of the cooling jacket and heat dissipation protrusions of the heat sink of the engine.

According to another aspect of the invention, a useful combination includes a heat source having a heat sink with an array of fins protruding from an external surface thereof for dissipating heat therefrom, a cooling jacket in close physical relation to the heat source (the cooling jacket having one of the above-described constructions), and a thermally conductive, solid material substantially filling the gap between the heat sink and the cooling jacket for transferring heat from the fins of the heat sink to the external surface of the cooling jacket.

The invention provides for post-installation modification of an air-cooled engine to permit cooling of a heat sink of the engine by a flow of coolant, by providing a cooling jacket. Recesses are defined in the external surface of the jacket, contoured to approximate the external shape of heat dissipation protrusions on the heat sink of the engine. The jacket housing is constructed to be assembled to the engine without removal of the heat sink from the engine.

The present invention can practically and cost-effectively enable the use of commercially available, air-cooled engines in applications which do not favor the dissipation of engine heat directly into the atmosphere about the engine. In some applications the use of such engines, modified according to the invention, can represent a significant cost savings over commercially available liquid-cooled engines with comparable performance ratings. These advantages are particularly realized in marine applications where water (e.g., lake or sea water) is available for use as a direct coolant.

DESCRIPTION OF THE PREFERRED EMBODIMENTS

Figure 1:
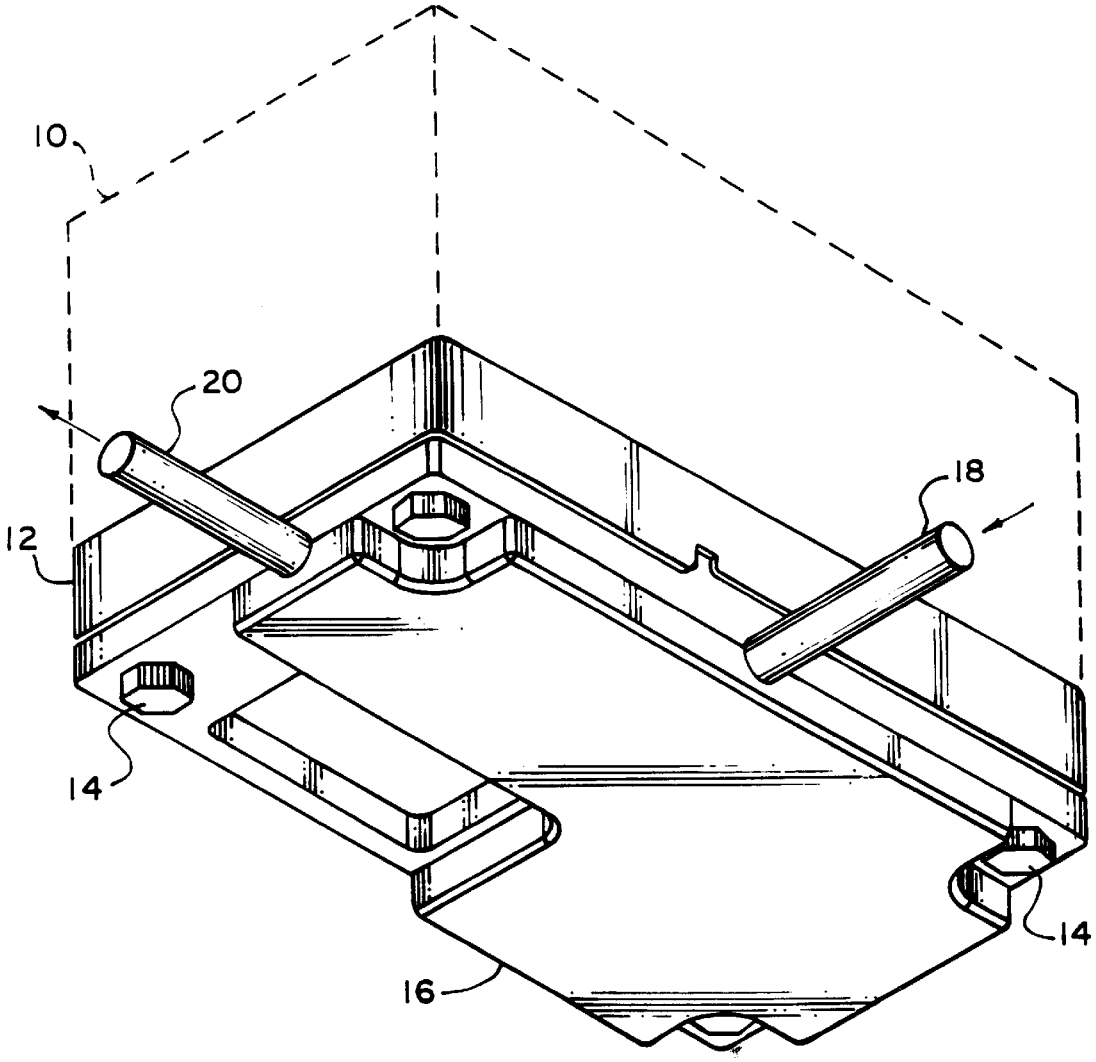
FIG. 1 is a perspective view of a cooling jacket assembled to an exposed surface of an engine oil sump.

Referring to FIG. 1, an engine 10 is constructed to be air-cooled and includes an oil sump 12. (For purposes of illustration, most of engine 10 is schematically represented as a box formed by dashed lines.) To improve the heat transfer capacity of the oil sump, a cooling jacket 16 has been attached to the oil sump with fasteners 14 to enable liquid cooling of the engine. An inlet hose 18 receives coolant from a coolant source (not shown) and an outlet hose 20 serves as a conduit for coolant returning to the coolant source. Coolant circulating through cooling jacket 16 thereby transfers heat from engine 10 to a remote area, such as a heat exchanger in an indirect cooling application, or, in a marine application with direct cooling, to a lake or ocean.

Figure 2:
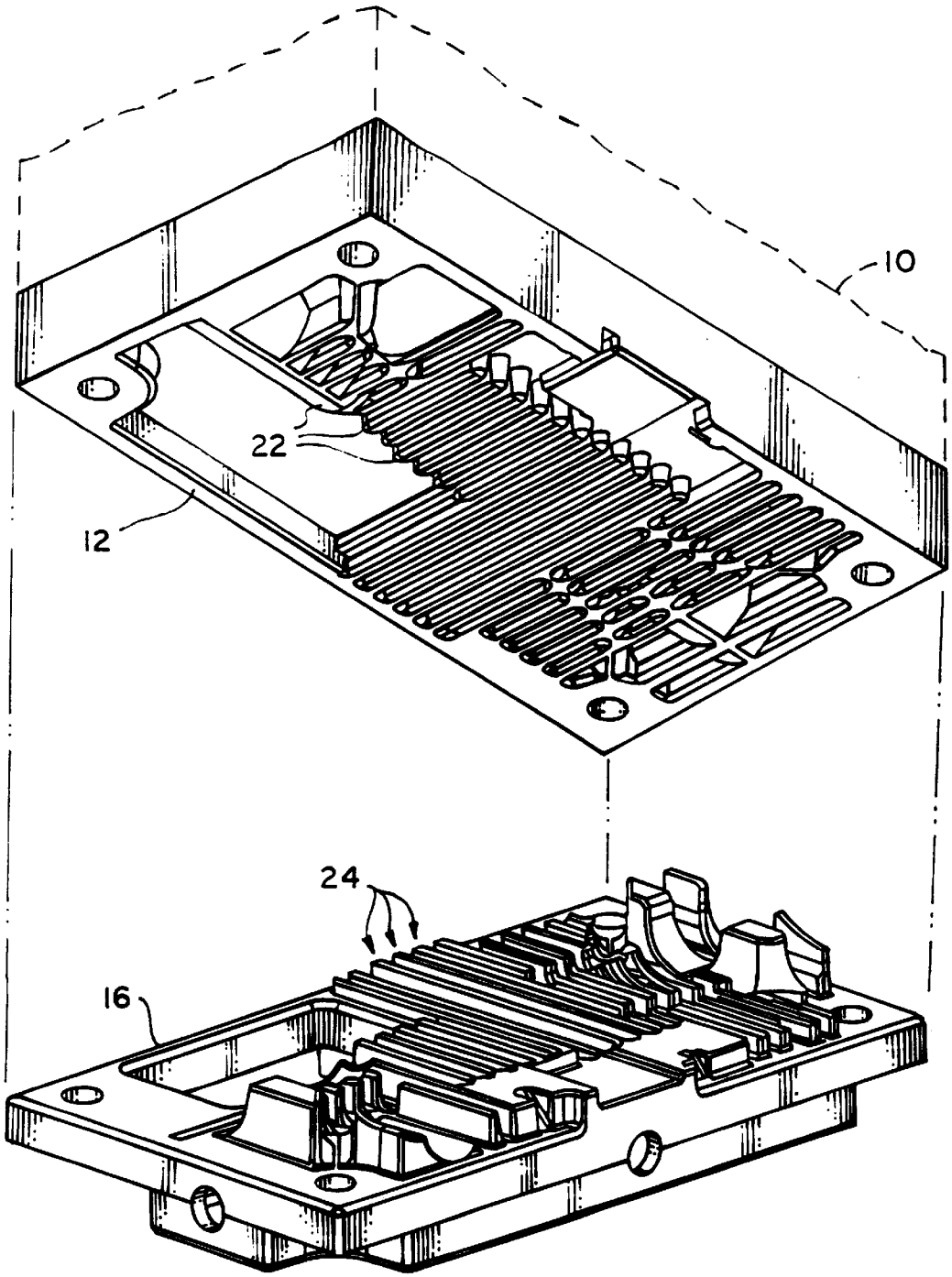
FIG. 2 is an exploded view of the cooling jacket and oil sump of FIG. 1, prior to assembly, illustrating the cooperating features of each.

FIG. 2 shows cooling jacket 16 separated from oil sump 12 to illustrate the construction of the interfacing surfaces of each. Oil sump 12 has an array of heat dissipation fins 22 and other surface contours designed to dissipate heat directly from the sump into a flow of air in an application as envisioned by the manufacturer of air-cooled engine 10. Fins 22 provide additional surface area for heat dissipation, compared to a flat surface occupying a similar space.

Cooling jacket 16 has a corresponding array of recesses 24 and surface contours arranged to "fit" the fins 22 and contours of oil sump 12. In effect, the interfacing surface of cooling jacket 16 is an approximation of the "negative image" of the interfacing surface of oil sump 12, such that when the two are placed together, fins 22 of the oil sump fit within the recesses 24 of the cooling jacket with only a nominal gap between the cooling jacket and the oil sump (as shown in FIG. 1).

A cooling jacket surface contour can be developed to mate with a finned external surface of a specific, commercially available engine, even without access to the design drawings of the engine surface. For example, three-dimensional scanning equipment can be used to physically scan the actual surface of a sample engine and generate a mathematical model of its contours. Using Computer-Aided-Design (CAD) 3-D modelling, a constant-thickness virtual layer can be applied to the electronic model of the engine surface to represent the desired nominal gap between the engine surface and the cooling jacket, and the desired surface contour of the cooling jacket can be constructed as the negative image of the layered engine surface contour.

Oil sump 12 is, in this example, a typical metal (e.g., aluminum) casting provided as part of an assembled, commercially available engine. Cooling jacket 16 may be produced by a number of common manufacturing techniques, such as sand casting. The cooling jacket material should be selected for, among other things, its ability to efficiently conduct heat. In marine applications with direct sea water cooling, the cooling jacket material must be carefully selected and sea water velocities limited to avoid corrosion and erosion of the cooling jacket. ALMAG 35™, an aluminum alloy available from Reynolds Metals in Richmond, Va., for instance, has been found to be acceptable for such applications, and is readily sand cast.

Figure 3:
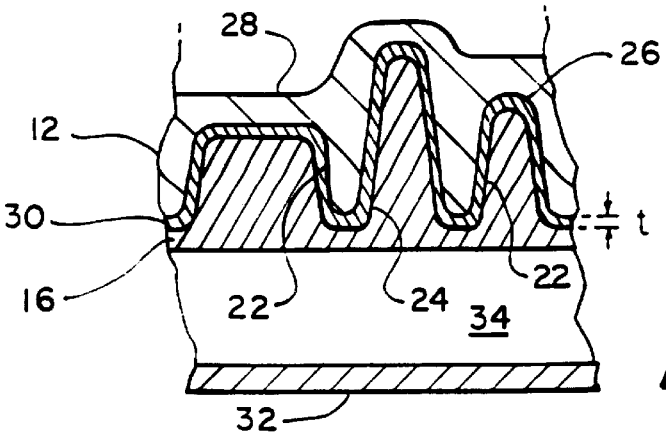
FIG. 3 is a fragmentary cross-section of the assembly of FIG. 1, taken in a plane generally perpendicular to the plane of interface between the cooling jacket and the oil sump surface.

The "fit" between the interfacing surfaces of oil sump 12 and cooling jacket 16 is illustrated in the cross-section shown in FIG. 3. The gap 26 between the interfacing surfaces of the oil sump and cooling jacket is filled with a thermally conductive potting material 30 (discussed in more detail below) to enhance the transfer of heat from the oil sump to the cooling jacket. Gap 26 has a nominal thickness, t, of preferably about 0.050 inch or less, more preferably less than about 0.020 inch. Given that resistance to thermal conductivity through a layer of material is proportional to the thickness of the material layer, the nominal thickness, t, of gap 26 should be minimized as much as is practically possible to maximize heat transfer across the interface between oil sump 12 and cooling jacket 16. However, due to normal irregularities in the surfaces of these parts as a result of the manufacturing process, it has been found that nominal gap thicknesses of the magnitudes mentioned above will allow for the variability in surface feature dimensions without excessive resistance to heat transfer.

Oil sump 12 has a surface 28 exposed to hot oil internal to the engine. Heat is conducted from this oil, through the oil sump, across gap 26 (filled with potting material 30) and into cooling jacket 16. Cooling jacket 16 has an outer wall 32 that encloses a coolant channel 34 through which the coolant is circulated to transfer the heat from the cooling jacket to a remote heat exchanger. Although not shown, cooling jacket 16 may contain an appropriate array of internal walls or protuberances in coolant channel 34 to enhance the transfer of heat to the flowing coolant.

Cooling jacket 16 is preferably permanently adhered to oil sump 12 by potting material 30, which also functions as a sealing adhesive to form a permanent bond between the two interfacing surfaces and resists intrusion of contaminants into gap 26. Separate fasteners 14 (FIG. 1) can also be used to further strengthen the coupling of the oil sump and cooling jacket, or simply to maintain pressure on the potting material as it cures.

Potting material 30 should have a high thermal conductivity (e.g., of preferably at least about 10 btu/ft$^2$/°F./hr/in, more preferably more than about 20 btu/ft$^2$/°F./hr/in), the ability to withstand temperature extremes and thermal cycling typical of engine applications, good surface wetting characteristics in order to form an low-resistance interface with fin surfaces, resistance to peeling from the fin surfaces, and compatibility with the types of fluids with which it may come in contact on an engine, such as gasoline, diesel fuel, engine oils and engine coolants. For marine applications, the potting material should demonstrate a high resistance to deterioration under salt water sprays. Potting longevity is critical to proper heat transfer, as even a small air gap that develops between the cooling jacket and the engine can significantly increase heat transfer resistance. Room temperature bond shear strengths of at least about 1,500 pounds per square inch are preferred, with bond shear strengths of at least about 2,500 pounds per square inch being more preferred, especially if the potting material is to function as the only means of retaining the cooling jacket to the engine. Possible potting materials for use with aluminum parts include Master Bond Polymer Adhesive Supreme 11ANHT, 10AOHT or 10ANHT (with advertised thermal conductivities ranging from 10 to 25 btu/ft$^2$/°F./hr/in), or Master Bond Polymer System EP21LV (a low viscosity, high bond strength alternative), all available from Master Bond, Inc. in Hackensack, N.J.

Figure 4:
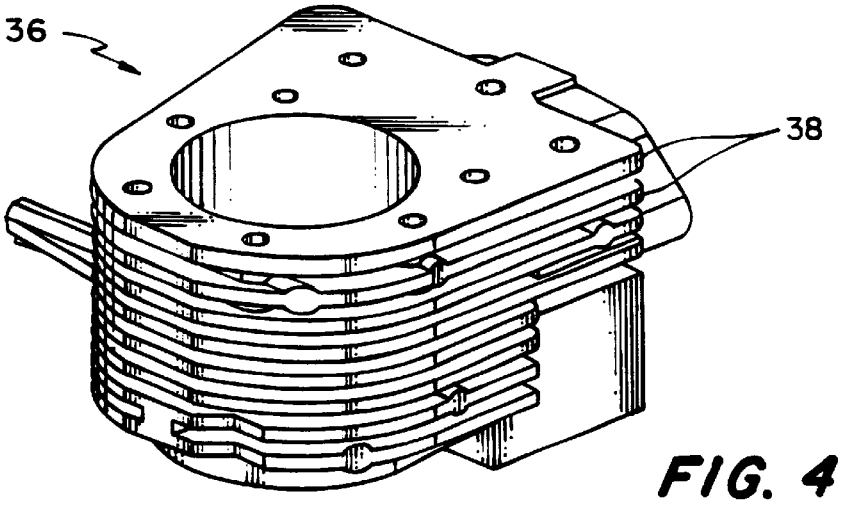
FIG. 4 is a perspective view of a finned, one-cylinder engine block.

Although the above embodiment has focused on the application of the invention to an oil sump, the same concepts described above can be employed to produce cooling jackets for use with other finned surfaces. For example, FIG. 4 shows a cylinder block 36 of an air-cooled, single cylinder engine, with parallel, elongated fins 38 extending about a significant portion of its external surface for increased heat transfer area. The cylinder head and other engine components have been removed for purposes of illustration.

Figure 5:
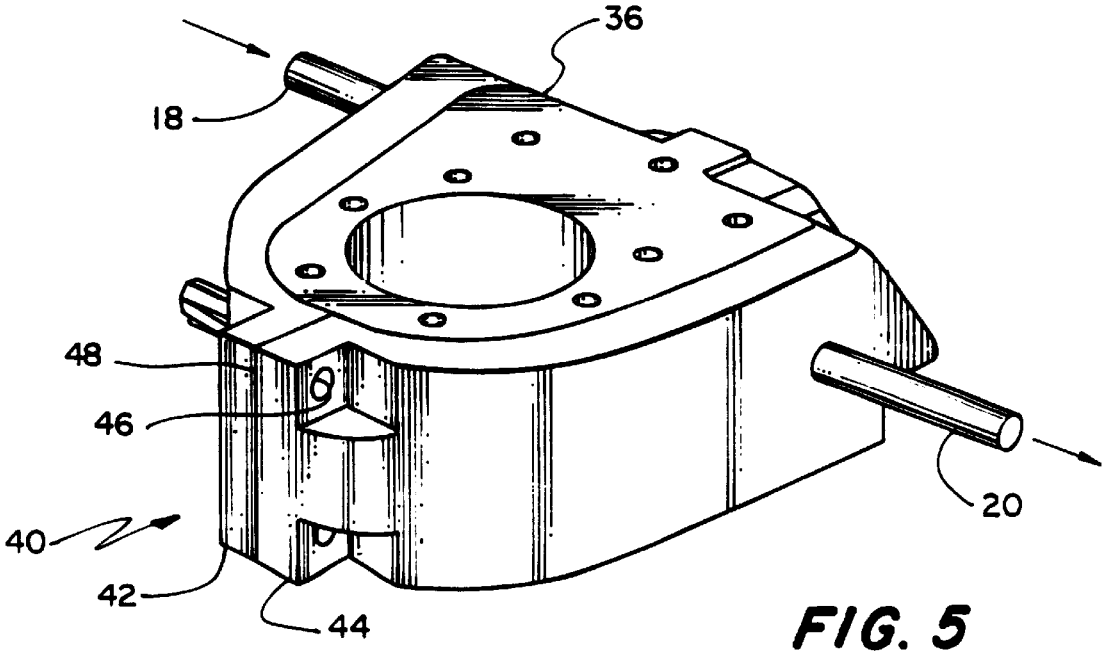
FIG. 5 is a perspective view of the engine block of FIG. 4, with a two-piece cooling jacket.

FIG. 5 shows the engine block 36 of FIG. 4 enclosed by a split, two piece cooling jacket 40 having left and right halves 42 and 44, respectively, with surface contours specifically designed to closely follow the fins of the block. Jacket halves 42 and 44 are held together by threaded fasteners (not shown) extending through holes 46 in the cooling jacket halves. Coolant circulates from left jacket half 42 to right jacket half 44 through a passage across sealed interface 48. With such split construction, cooling jacket 40 can be assembled to block 36 of an assembled engine without having to remove the cylinder head and other major engine components (although disassembly of miscellaneous minor components, such as hoses and cables, may be required).

Figure 6:
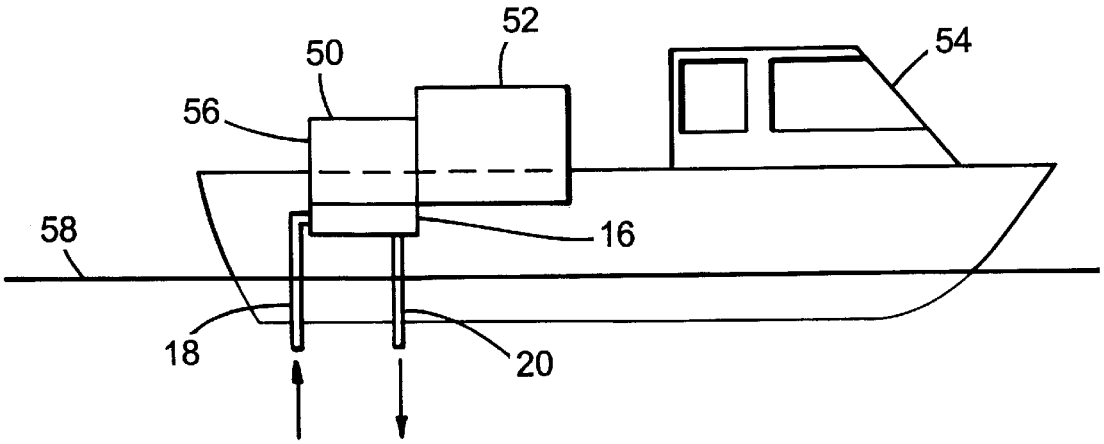
FIG. 6 illustrates an engine-driven generator in a marine power application.

Additional cooling jackets may be attached to the cylinder head or to any other engine surface that is densely finned to dissipate heat. Multiple cooling jackets mounted on a single engine may be connected with appropriate plumbing to circulate coolant in series through all of the cooling jackets. FIG. 6 shows as modified engine 50 coupled to a generator 52 to provide auxiliary power on a boat 54. The engine is adapted to be liquid cooled, and consists essentially of an air-cooled engine 56 (i.e., an engine constructed to be normally cooled primarily by convective heat transfer directly to atmospheric air, as illustrated as 10 in FIG. 1) and a cooling jacket 16 attached to the engine. Water from lake 58 is circulated through cooling jacket 16 to transfer heat from engine 50 to lake 58.

Other embodiments and features are also within the scope of the following claims.

What is claimed is:

1. A method of cooling a heat source having a housing with fins extending from a surface thereof for direct convective heat transfer with a fluid medium, the method comprising providing a cooling jacket having recesses defined in a surface thereof, for receiving the fins of the housing of the heat source, and a coolant passage defined therein;

placing the cooling jacket in close proximity to the heat source housing, such that the fins of the housing of the heat source protrude into the recesses of the cooling jacket in a heat transferring relationship; and flowing a liquid coolant through the coolant passage of the cooling jacket.

2. The method of claim 1 wherein the fins and recesses define therebetween a gap, the method further comprising the step of placing a thermally conductive material on at least one of said surfaces to substantially fill the gap between the fins and recesses with the thermally conductive material.

3. The method of claim 1 wherein the heat source comprises an engine constructed to be air-cooled by flowing air across said fins.

4. The method of claim 2 wherein the gap between the fins and recesses has a nominal thickness of less than about 0.050 inch.

5. The method of claim 4 wherein the nominal thickness of the gap between the fins and recesses is less than about 0.020 inch.

6. The method of claim 2 wherein said thermally conductive material has a thermal conductivity of at least about 10 btu/ft$^2$/°F./hr/in.

7. The method of claim 6 wherein said thermally conductive material has a thermal conductivity of at least about 20 btu/ft$^2$/°F./hr/in.

8. The method of claim 2 wherein said thermally conductive material has a room temperature bond shear strength of about 1,500 or more pounds per square inch.

9. The method of claim 8 wherein said thermally conductive material has a room temperature bond shear strength of about 2,500 or more pounds per square inch.

10. The method of claim 1 wherein the liquid coolant comprises sea water.

11. The method of claim 3 wherein the step of providing a cooling jacket includes scanning a finned surface of the engine to determine the topology of the finned surface and constructing the cooling jacket to accommodate the determined topology.

12. A cooling jacket for transforming an air-cooled engine into a liquid-cooled engine by removing heat from heat dissipation protrusions on a heat sink of the engine by a flow of liquid coolant, the cooling jacket comprising a jacket housing having an external surface and an internal coolant passage with an inlet and an outlet, and recesses defined in said external surface, the recesses contoured to approximate the external shape of the heat dissipation protrusions on the engine heat sink.

13. The cooling jacket of claim 12 wherein the jacket housing comprises an aluminum alloy.

14. The cooling jacket of claim 12 wherein said external surface of the jacket housing is of sand-cast form.

15. The cooling jacket of claim 12 comprising at least two housing portions constructed to cooperate to enclose a finned engine component.

16. The cooling jacket of claim 12 wherein the cooling jacket is mounted to a finned surface of the engine.

17. The cooling jacket of claim 16 further comprising a solid, thermally conductive material between said external surface of the cooling jacket and the heat dissipation protrusions of the heat sink.

18. In combination, a heat source having a heat sink with an array of fins protruding from an external surface thereof for dissipating heat therefrom;

a cooling jacket in close physical relation to the heat source, the cooling jacket comprising a jacket housing having an external surface and an internal coolant passage with an inlet and an outlet, and recesses defined in the external surface of the jacket housing, the recesses contoured to approximate the external shape of the fins of the array of fins of said heat sink and defining, with said fins, a gap between the external surface of the jacket housing and the external surface of the heat sink; and a thermally conductive, solid material substantially filling said gap for transferring heat from the fins of the heat sink to the external surface of the cooling jacket.

19. The combination of claim 18 wherein the heat source comprises an engine constructed to be air-cooled by flowing air across said fins.

20. The combination of claim 18 wherein the gap between the fins and recesses has a nominal thickness of less than about 0.050 inch.

21. The combination of claim 18 wherein said thermally conductive material has a thermal conductivity of at least about 10 btu/ft$^2$/°F./hr/in.

22. The combination of claim 18 wherein said thermally conductive material has a room temperature bond shear strength of about 1,500 or more pounds per square inch.

23. The combination of claim 18 wherein the liquid coolant comprises sea water.

24. For post-installation modification of an air-cooled engine to permit cooling of a heat sink of the engine by a flow of coolant, a cooling jacket comprising a jacket housing having an external surface and an internal coolant passage with an inlet and an outlet, and recesses defined in said external surface, the recesses contoured to approximate the external shape of heat dissipation protrusions on the heat sink of the engine, the jacket housing constructed to be assembled to the engine without removal of the heat sink from the engine.

25. In a cooling jacket for transforming an air-cooled engine into a liquid-cooled engine by removing heat from heat dissipation protrusions on a heat sink of the engine by a flow of liquid coolant, the cooling jacket comprising a jacket housing having an inlet and an outlet for circulating coolant through the jacket, the improvement wherein the jacket housing comprises a hollow housing defining therewithin an internal coolant channel between said inlet and outlet, the jacket housing having an external surface with recesses defined therein, the recesses contoured to approximate the external shape of the heat dissipation protrusions on the heat sink of the engine.

26. A method of transforming an air-cooled engine into a liquid-cooled engine, the method comprising forming a cooling jacket to have an outer surface contoured to conform to an outer surface of a heat sink of the engine, the cooling jacket defining an internal conduit therethrough for the flow of a liquid coolant; and attaching the cooling jacket to the engine with the contoured outer surface of the jacket and the outer surface of the engine heat sink arranged in a heat conducting relationship with the outer surface of the heat sink, whereby subsequently flowing liquid coolant through the internal conduit of the cooling jacket will remove heat from the engine during operation.

27. The method of claim 26 wherein the outer surface of the cooling jacket defines a recess adapted to receive a corresponding projection of the outer surface of the engine heat sink.

28. The method of claim 26 wherein the outer surface of the cooling jacket and the outer surface of the engine heat sink define a gap therebetween, the method including the step of substantially filling the gap with a material having a thermal conductivity of at least about 10 btu/ft$^2$/°F./hr/in.

29. A method of providing auxiliary power on a boat, the method comprising providing an engine-driven generator having an engine adapted to be liquid cooled, the engine consisting essentially of an operable engine constructed to be normally air-cooled; and a cooling jacket attached to the engine and having an outer surface contoured to conform to a contour of an outer surface of a heat sink of the engine, the cooling jacket defining an internal conduit therethrough and being arranged in a heat conducting relationship with the outer surface of the heat sink; and running the engine-driven generator to supply power; while flowing water from an external source through the internal conduit of the cooling jacket to remove engine heat.

30. The method of claim 29 wherein the external source is a lake, sea or ocean.

31. The method of claim 27 wherein the outer surface of the cooling jacket defines a recess adapted to receive a corresponding projection of the outer surface of the engine heat sink.

32. The method of claim 29 wherein the outer surface of the cooling jacket and the outer surface of the engine heat sink define a gap therebetween substantially filled with a material having a thermal conductivity of at least about 10 btu/ft$^2$/°F./hr/in.

33. An engine-driven generator comprising a generator; and an engine adapted to be liquid cooled, the engine consisting essentially of an operable engine constructed to be normally air-cooled; and a cooling jacket attached to the engine and having an outer surface conforming to a contour of an outer surface of a heat sink of the engine, the cooling jacket defining an internal conduit therethrough and being arranged in a heat conducting relationship with the outer surface of the heat sink, the conduit adapted to convey water from and to an external source to remove engine heat.

34. The engine-driven generator of claim 33 wherein the external source is a lake, sea or ocean.

35. The generator of claim 33 wherein the outer surface of the cooling jacket defines a recess adapted to receive a corresponding projection of the outer surface of the engine heat sink.

36. The generator of claim 33 wherein the outer surface of the cooling jacket and the outer surface of the engine heat sink define a gap therebetween substantially filled with a material having a thermal conductivity of at least about 10 $btu/ft^2/°F./hr/in$.

* * * * *